United States Patent [19]

Hiki et al.

[11] 4,311,401

[45] Jan. 19, 1982

[54] PRINTING APPARATUS WITH INKED RIBBON LIFT RESTRAINER

[75] Inventors: Toshio Hiki; Kazuo Sugano, both of Katsuta, Japan

[73] Assignee: Hitachi Koki Company, Limited, Tokyo, Japan

[21] Appl. No.: 57,899

[22] Filed: Jul. 16, 1979

[30] Foreign Application Priority Data

May 7, 1979 [JP] Japan ..... 54-56190

[51] Int. Cl.[3] ..... B41J 35/04

[52] U.S. Cl. ..... 400/248; 101/336; 400/656; 400/196.1

[58] Field of Search ..... 400/146, 247, 248, 656, 400/657, 196.1; 101/93.14, 102, 111, 336

[56] References Cited

U.S. PATENT DOCUMENTS

| | | | |
|---|---|---|---|
| 2,405,562 | 8/1946 | Ellerbeck | 101/336 X |
| 3,017,981 | 1/1962 | Keith | 400/248 |
| 3,135,198 | 6/1964 | Kingsley | 101/336 X |
| 3,730,082 | 5/1973 | Perry | 101/336 X |

OTHER PUBLICATIONS

IBM Technical Disclosure Bulletin, "Ribbon Retainer", Bonafino et al., vol. 19, No. 2, Jul. 1976, p. 439.

*Primary Examiner*—Ernest T. Wright, Jr.

*Attorney, Agent, or Firm*—Lowe, King, Price & Becker

[57] ABSTRACT

In a printing apparatus having a platen, a plurality of print hammers arranged in a horizontal row and a horizontally movable type carrier on which print carriers are arranged, a restraining member limits upward movement of a horizontally movable ink ribbon and thereby eliminates character omission. Between the print hammers and the type carriers are disposed the horizontally movable ink ribbon and a vertically movable print sheet on which a character impression is made upon impact of a selectively energized hammer. The print sheet is folded along transverse cut lines to define forms which are stacked together below the apparatus. When the print sheet is pulled upwardly, the folded portion tends to drag the ink ribbon upwardly displacing the ribbon from its print position. The restraining member is mounted above the ink ribbon to limit this upward movement of the ribbon.

6 Claims, 6 Drawing Figures

PRINTING APPARATUS WITH INKED RIBBON LIFT RESTRAINER

FIELD OF THE INVENTION

The present invention relates in general to printing apparatus of the type having a horizontally movable type-carrier, a horizontally movable ink ribbon and a plurality of print hammers, and more particularly to a printing apparatus in which unwanted lifting of the ink ribbon is prevented to eliminate loss of print characters.

OBJECTS OF THE INVENTION

It is an object of the present invention to provide a printing apparatus having a ribbon lift restrainer which limits undesirable upward movement of an ink ribbon to prevent loss of print characters.

It is another object of the present invention to provide an improved printing apparatus which can be constructed by slightly modifying a part in existing printing apparatus.

According to the present invention, there is provided a printing apparatus having a printing zone where printing action is made and comprising a type-carrier running horizontally along the printing zone and having characters formed thereon; a plurality of print hammers juxtaposed in a row along the printing zone; a platen straightly extending along the printing zone at a position behind the type-carrier with respect to the row of the print hammers; and an ink ribbon running parallel with the typecarrier along the printing zone at a position between the type-carrier and the row of the print hammers. A print sheet runs vertically between the ink ribbon and the row of the print hammers in a direction parallel with the face of the ink ribbon.

A separating member is provided to maintain a distance between the ribbon and the print sheet to prevent smearing of the latter by the ribbon ink. This separating member has a cutout portion to define a print zone to allow print hammers to make impact therethrough on the ink ribbon. A folded portion of the print sheet has a tendency to extend through the print zone into contact with the ribbon as sheet 32 is advanced to a new print line position thereby dragging the ribbon upwardly. This causes the ribbon to displace from the print position and a loss of print characters will result if the ribbon fails to return to the print position before a hammer is subsequently activated. A restraining member is mounted above the ink ribbon to limit its undesirable upward movement.

Other objects and advantages of the present invention will become clear from the following description when taken in conjunction with the accompanying drawing.

DETAILED DESCRIPTION OF THE PREFERRED EMBODIMENT

Figure 1:
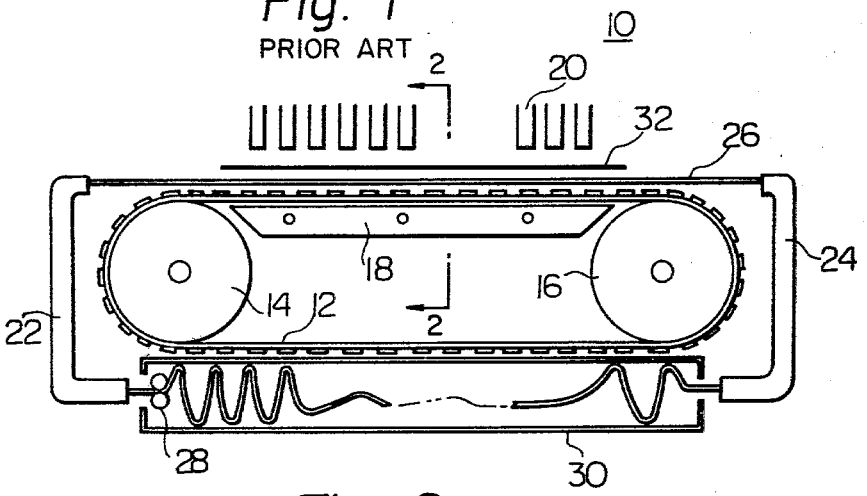
Fig. 1 PRIOR ART
FIG. 1 is a schematic plan view of a prior art printing apparatus.
Figure 2:
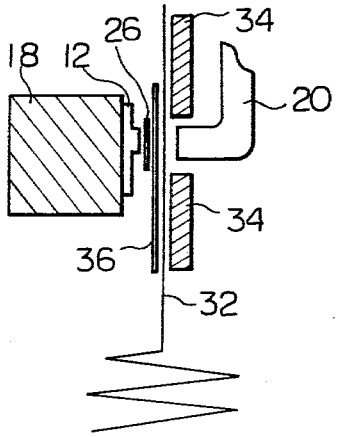
Fig. 2 PRIOR ART
FIG. 2 is a cross sectional view of an existing printing apparatus taken along the line 2—2 of FIG. 1.
Figure 3:
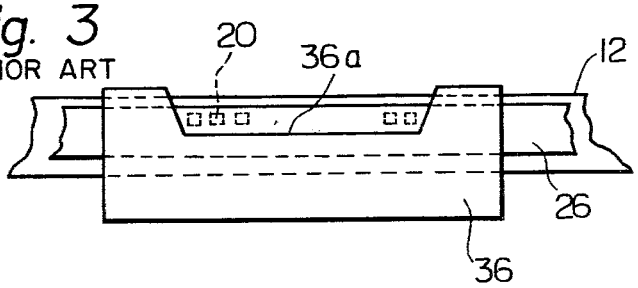
Fig. 3 PRIOR ART
FIG. 3 is a partial front view of the printing apparatus of FIG. 1, showing positional relationship between a ribbon separator and an inked ribbon.

Prior to describing the invention, reference is first made to FIGS. 1 to 3 in which a prior art printing apparatus is illustrated. This type of printing apparatus is clearly described in U.S. patent application Ser. No. 909,106 filed May 24, 1978 by Takahiro Yamamoto et al. and assigned to the same assignee as the present invention, now U.S. Pat. No. 4,210,076.

The printing apparatus 10, shown in FIG. 1, comprises a type-carrier 12 having, for example, a flexible endless belt having formed thereon a series of type characters. The type-carrier 12 is supported by a driving pulley 14 and a driven pulley 16 to move along a horizontal path. Inside the endless type-carrier 12 is located a platen 18 which extends parallel with a straight section of the endless type-carrier 12. Located opposite the platen 18 and parallel with the straight section of the endless type-carrier 12 is a plurality of print hammers 20 (only one is numbered) which are juxtaposed in a row facing the platen 18.

Between type-carrier 12 and the row of hammers 20 is a section of an endless ink ribbon 26 which is slidably supported by a pair of guides 22 and 24. The ink ribbon 26 is engaged between pinch rollers 28 and stored within cassette 30. Between the row of hammers 20 and the ink ribbon 26, there is a print sheet 32 which is arranged to move in a direction normal to the plane of FIG. 1. As is seen in FIG. 2, a hammer plate 34 is provided which serves as a guide for sheet 32 and between the print sheet 32 and the ink ribbon 26 is arranged a ribbon separator 36 which functions to prevent the portions of print sheet 32 which are outside a printing zone (see FIG. 3) from touching the ink ribbon 26. This printing zone is defined by an elongated cutout portion **36*a* of ribbon separator 36**.

Print sheet 32 is formed with a longitudinally spaced transverse series of cuts along which the sheet 32 is successively folded in opposite directions and stored in a stack relation as illustrated in FIG. 2, so that the sheet 32 may be manually separated apart into forms after printing. The folded edges of the stacked sheets 32 tend to extend through the cutout portion **36*a* into contact with the ink ribbon 26 as the sheet 32 is advanced upward to a new line position. This drags the print section of ribbon 26 upwardly. If ribbon 26 fails to return to the original position before the next printing action occurs, the ribbon 26 will be displaced from the print position resulting in a loss of a character print on sheet 32**.

Figure 4:
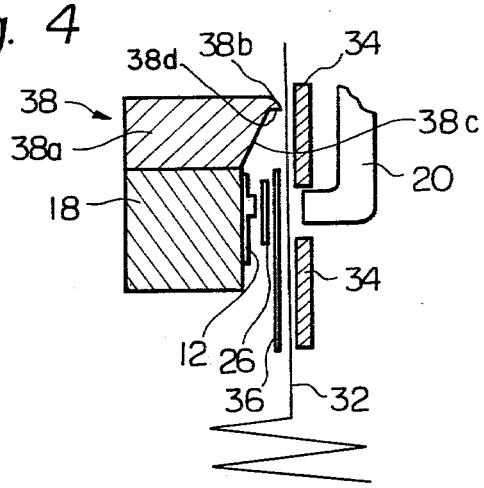
FIG. 4 is a view similar to FIG. 2, but shows a first embodiment of the present invention

Referring now to FIG. 4, there is shown a first embodiment of the invention in which the same parts as those of FIG. 2 are designated by corresponding numerals. In this first embodiment, a stopper 38 for restraining upward movement of the ink ribbon 26 is employed, which is constructed from aluminium, plastics or the like and is firmly mounted on the platen 18 by suitable fastening means. The stopper 38 extends along the longitudinal length of the platen 18 and consists of a base **38*a* attached to the platen 18 and a projection 38*b* protruding toward the print hammers 20. The projection 38*b* has a generally bill-shaped cross section and is positioned at the inside upper ridge section of the base 38*a*, extending along the same. The projection 38*b* is sized and constructed so that at least a part thereof, such as a leading end thereof, protrudes toward the print hammers 20 beyond an imaginary plane which includes the face of the ink ribbon 26 which assumes its normal position. The base 38***a* has an inclined flat inside surface 38*c* terminating at the foot of the projection 38*b*. The inclination angle of the surface 38*c* relative to the imaginary plane is selected to have a value in a range from approximately 3° to approximately 10°.

The tendency of print sheet 32 to shift toward ink ribbon 26 is restricted therefore by projection 38*b* reducing the possibility of sheet 32 contacting with ribbon 26. Furthermore, even if the ink ribbon 26 is forced to lift by undesirable contact with the folded portion of sheet 32 when the latter is advanced upwardly to a new line position this lifting movement of the ribbon 26 is limited by the inclined flat surface 38*c* of the stopper 38. In fact, experiments show that the ink ribbon 26 is brought into contact with the surface 38*c* upon lifting thereof and returns to its normal position quickly by the time the following hammering action of the print hammers 20 starts. Even if the lift of the ribbon 26 further proceeds, the projection 38*b* will surely stop lifting of the ribbon 26 by a downward facing flat surface 38*d*. It should be noted that since the flat inside surface 38*c* of the base 38*a* which the ink ribbon 26 is to contact is inclined with respect to the imaginary plane which includes the face of the ribbon 26 taking the normally operating position, the ribbon 26 will never be flexed upon contact with surface 38*c*.

Experiments show that substantially the same effect is achieved if surface 38*c* is convexed or concaved.

Figure 5:
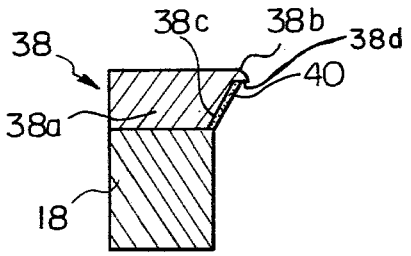
FIGS. 5 and 6 are views similar to FIG. 2, but show second and third embodiments of the present invention, respectively.

In FIG. 5, a second embodiment of the invention is shown, which is substantially the same as the first embodiment except that a high friction member 40, such as emery paper, is bonded to the inclined flat surface 38*c* of the base 38*a*.

Figure 6:
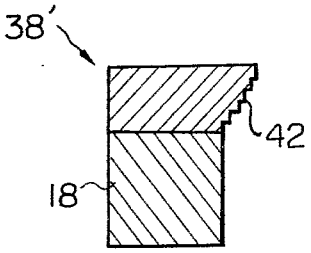

In a third embodiment of the invention shown in FIG. 6, the restraining member 38' is shaped so that the inclined surface equivalent to surface 38*c* has plural step portions 42 extending parallel with the longitudinal length of the stopper 38'.

With the second and third embodiments, the lifting of the ink ribbon 26 is much more restricted in comparison with the first embodiment.

Although shown and described as a separate element the restraining member 38 (38') can be constructed integrally with platen 18 as a one piece unit.

With the above, it will be appreciated that in accordance with the present invention, the displacement of ribbon 26 from print position is prevented when a hammer 20 is operated to provide an impression on sheet 32.

What is claimed is:

1. A printing apparatus having a print sheet with folded edges to define forms which are stacked upon each other below the apparatus and arranged to be successively advanced upwardly to a new print line position, comprising a platen, a plurality of print hammers arranged in a horizontal row, a horizontally movable type carrier having a plurality of type characters mounted between said platen and said row of hammers defining therewith a space in which a horizontally movable ink ribbon and a section of said print sheet are disposed in parallel relation, said folded edges of said print sheet having a tendency to make contact with said ribbon upon advancement of the print sheet dragging the ribbon upwardly and displacing said ribbon from a position corresponding to that of said hammers, and a stationary restraining member mounted on said platen to limit the upward movement of said ink ribbon and having a projection extending toward said hammers and an inclined surface extending downwardly from said projection at an acute angle to the surface of said ink ribbon to said platen for making contact with said ink ribbon at said angle when said ribbon is dragged upwardly.

2. A printing apparatus as claimed in claim 1, wherein said inclined surface has a coefficient of friction with said ink ribbon sufficient to substantially impede upward movement of said ribbon along said inclined surface.

3. A printing apparatus as claimed in claim 1, further comprising a separating member for maintaining said ink ribbon and said print sheet spaced apart from each other, said separating member being formed with a recess for defining a printing zone to permit one or more of said hammers to strike said type carrier through said zone.

4. A printing apparatus having a print sheet with folded edges to define forms which are stacked upon each other below the apparatus and arranged to be successively advanced upwardly to a new print line position, comprising a platen, a plurality of print hammers arranged in a horizontal row, a horizontally movable type carrier having a plurality of type characters mounted between said platen and said row of hammers defining therewith a space in which a horizontally movable ink ribbon and a section of said print sheet are disposed in parallel relation, said folded edges of said print sheet having a tendency to make contact with said ribbon upon advancement of the print sheet dragging the ribbon upwardly and displacing said ribbon from a position corresponding to that of said hammers, and a stationary restraining member mounted above said ink ribbon to limit the upward movement of said ink ribbon and having an inclined surface extending at an angle to the surface of said ink ribbon in a direction away from said platen for making contact with said ink ribbon at said angle when said ribbon is dragged upwardly, wherein said inclined surface is provided with a frictional member including a sheet of emery paper or the like.

5. A printing apparatus having a print sheet with folded edges to define forms which are stacked upon each other below the apparatus and arranged to be successively advanced upwardly to a new print line position, comprising a platen, a plurality of print hammers arranged in a horizontal row, a horizontally movable type carrier having a plurality of type characters mounted between said platen and said row of hammers defining therewith a space in which a horizontally movable ink ribbon and a section of said print sheet are disposed in parallel relation, said folded edges of said print sheet having a tendency to make contact with said ribbon upon advancement of the print sheet dragging the ribbon upwardly and displacing said ribbon from a position corresponding to that of said hammers, and a stationary restraining member mounted above said ink ribbon to limit the upward movement of said ink ribbon and having an inclined surface extending at an angle to the surface of said ink ribbon in a direction away from said platen for making contact with said ink ribbon at said angle when said ribbon is dragged upwardly, wherein said inclined surface is shaped to form parallel stepped portions.

6. A printing apparatus having a print sheet with folded edges to define forms which are stacked upon each other below the apparatus and arranged to be successively advanced upwardly to a new print line position, comprising a platen, a plurality of print hammers arranged in a horizontal row, a horizontally movable type carrier having a plurality of type characters mounted between said platen and said row of hammers defining therewith a space in which a horizontally movable ink ribbon and a section of said print sheet are disposed in parallel relation, said folded edges of said print sheet having a tendency to make contact with said ribbon upon advancement of the print sheet dragging the ribbon upwardly and displacing said ribbon from a position corresponding to that of said hammers, and a stationary restraining member mounted above said ink ribbon to limit the upward movement of said ink ribbon and having an inclined surface extending at an angle to the surface of said ink ribbon in a direction away from said platen for making contact with said ink ribbon at said angle when said ribbon is dragged upwardly, wherein said angle is in a range from approximately 3° to 10°.

* * * * *